US007334937B2

(12) United States Patent
Arribau et al.

(10) Patent No.: US 7,334,937 B2
(45) **Date of Patent: *Feb. 26, 2008**

(54) IMPELLER VANE ASSEMBLY FOR LIQUID/SOLID BLENDERS

(76) Inventors: Jorge O. Arribau, 3188 South York, Englewood, CO (US) 80110; Michael G. Dubic, 7266 South Chapparal Cir. E, Centennial, CO (US) 80016

( * ) Notice: Subject to any disclaimer, the term of this patent is extended or adjusted under 35 U.S.C. 154(b) by 151 days.

This patent is subject to a terminal disclaimer.

(21) Appl. No.: 10/836,555

(22) Filed: Apr. 29, 2004

(65) Prior Publication Data

US 2004/0218465 A1 Nov. 4, 2004

Related U.S. Application Data

(63) Continuation-in-part of application No. 10/428,276, filed on May 2, 2003, now Pat. No. 6,974,246.

(51) Int. Cl.
*B01F 5/12* (2006.01)

(52) U.S. Cl. ..... 366/164.6; 366/181.3; 366/264; 366/317; 415/98; 415/102

(58) Field of Classification Search ..... 366/164.6, 366/181.3, 263, 264, 317; 415/71, 98, 102
See application file for complete search history.

(56) References Cited

U.S. PATENT DOCUMENTS 1,062,803 A * 5/1913 Simond ..... 415/71
2,226,470 A 12/1940 McGuffee
2,272,573 A * 2/1942 Messmore ..... 366/263
3,256,181 A 6/1966 Zingg et al.
3,326,536 A 6/1967 Zingg et al.
3,339,897 A 9/1967 Davis, Jr.
3,953,150 A * 4/1976 Onal ..... 416/184
4,239,396 A 12/1980 Arribau et al.
4,453,829 A 6/1984 Althouse, III
4,460,276 A 7/1984 Arribau et al.
4,614,435 A 9/1986 McIntire
4,628,391 A 12/1986 Nyman et al.

(Continued)

*Primary Examiner*—David Sorkin
(74) *Attorney, Agent, or Firm*—The Reilly Intellectual Property Law Firm, P.C.; John E. Reilly; Ellen Reilly

(57) ABSTRACT

An impeller vane assembly for blending liquids with solid particulate matter in which a center drive shaft extends through a housing having a solid particle inlet and a liquid inlet together with an outlet, and upper and lower impeller vanes are aligned respectively with the particle inlet and liquid inlet to cause intermixing of the solids and liquids by counterflow of the liquid into the upper impeller region, the upper and lower vanes being separated by a common divider plate, and the vanes are characterized by being curved in the direction of rotation of the impeller and having outer radially extending tips which terminate at the outer peripheral edge of the common divider plate, the vanes being operative to balance the point at which the solids and liquid are intermixed between the solid particle inlet and annular space surrounding the impeller. In one embodiment, expeller blades are employed in inner concentric relation to the upper impeller vanes to accelerate the flow of solid particles into the upper impeller region, and baffle plates or deflector members are employed above and below the upper and lower impellers to prevent any leakage of liquid into the center of the impeller.

15 Claims, 7 Drawing Sheets

U.S. PATENT DOCUMENTS 4,834,542 A 5/1989 Sherwood
4,850,702 A 7/1989 Arribau et al.
4,893,941 A 1/1990 Wayte
5,904,419 A * 5/1999 Arribau ..... 366/167.2
6,428,711 B1 * 8/2002 Nakamura et al. ..... 210/747
6,974,246 B2 * 12/2005 Arribau et al. ..... 366/164.6

* cited by examiner

IMPELLER VANE ASSEMBLY FOR LIQUID/SOLID BLENDERS

CROSS-REFERENCE TO RELATED APPLICATION

This application is a continuation-in-part of patent application Ser. No. 10/428,276 filed May 2, 2003, now U.S. Pat. No. 6,974,246, for METHOD AND APPARATUS FOR BLENDING LIQUIDS AND SOLIDS INCLUDING NOVEL AND IMPROVED IMPELLER ASSEMBLY by Jorge O. Arribau and Michael G. Dubic, incorporated by reference herein.

BACKGROUND AND FIELD OF INVENTION

This invention relates to blenders as well as pumping apparatus; and more particularly relates to a novel and improved method and apparatus for blending liquids with solid particulate materials, and still further relates to a novel and improved impeller assembly which is conformable for use with blenders as well as centrifugal pumps.

Numerous types of blenders have been devised for intermixing and pumping large volumes of liquid/solid slurries. For example, downhole operations in oil and gas fields, such as, fracturing and cementing operations utilize a blender in which liquids and solids are introduced into a housing, a rotor within the housing, upper and lower impeller portions for intermixing the materials and throwing or advancing the materials outwardly into an annulus surrounding the rotor from which the resultant intermixture or slurry can be discharged into the well. A representative blender is that set forth and described in U.S. Pat. No. 5,904,419 to Jorge O. Arribau, one of the inventors of this invention which patent is incorporated by reference herein (hereinafter referred to as the '419 patent). Other representative patents are U.S. Pat. No. 4,239,396 to Arribau; U.S. Pat. Nos. 3,256,181 and 3,326,536 to Zingg; U.S. Pat. No. 4,850,702 to Arribau and U.S. Pat. No. 4,460,276 to Arribau.

In the '419 patent, liquids were introduced through mixing apertures intermediately between the rotor and annulus for mixing with the solid particles prior to introduction into the relatively high pressure annulus.

There is a continuing but unmet need for a blender of simplified construction which can regulate the balance or mixing point between the solids and slurry in a region radially inwardly of the annulus and be capable of pumping the slurry under a substantially constant pressure over a wide range of mass flow rates. There is similarly a need for an impeller assembly in which impeller vanes are designed to regulate the slurry pressure as well as to prevent liquid or slurry leakage back into the central expeller area. Still further, to decrease the depth of vanes required for the upper impeller region by encouraging more immediate outward flow of sand to achieve the same capacity or mass flow rate as deeper vanes.

SUMMARY OF THE INVENTION

It is therefore an object of the present invention to provide for a novel and improved method and apparatus for blending liquids and solid particles by counterflow of the liquid with respect to the direction of solid flow through an impeller region.

It is another object of the present invention to establish a balance point between liquid and solid particle intermixture in an impeller for a blender and to control the pressure and velocity of liquid/solid flow by regulating the size, length and configuration of the impeller vanes.

It is a further object of the present invention to prevent backflow of liquids or solid particles around impeller zones of a blender apparatus.

It is a still further object of the present invention to provide in a pumping system for an impeller design capable of maintaining substantially constant pressure of a liquid/solid slurry over a wide range of mass flow rates.

In accordance with the present invention, there is provided in apparatus for blending liquids with solid particles in which a housing has an upper solid particle inlet and lower liquid inlet, a center drive shaft in said housing and outlet communicating with an annular space in outer spaced surrounding relation to the drive shaft, the invention characterized by having upper impeller vane means mounted for rotation on the shaft whereby to direct solid particles from the inlet toward the annular space, lower impeller vane means mounted for rotation on the drive shaft whereby to direct liquid from the liquid inlet through the annular space to intermix by counterflow of the liquid with the solid particles, and a plate interposed between the upper and lower impeller vane means. In the preferred form, the upper impeller means includes inner and outer concentric vanes, the inner vanes being operative to force the solid particles into the outer impeller vane region at a rate sufficient to substantially reduce the height of the outer vanes necessary to intermix the desired ratio of solid particles to liquids and prevent any tendency of the solid particles to back up into the center inlet region. In another preferred form of invention, the radial tips of the upper impeller vanes are lengthened to discourage return flow of the liquids or slurries toward the center of the impeller region.

The above and other objects, advantages and features of the present invention will become more readily appreciated and understood from the following description of preferred and modified forms of invention when taken together with the accompanying drawings in which:

DETAILED DESCRIPTION OF PREFERRED EMBODIMENTS

Figure 7:
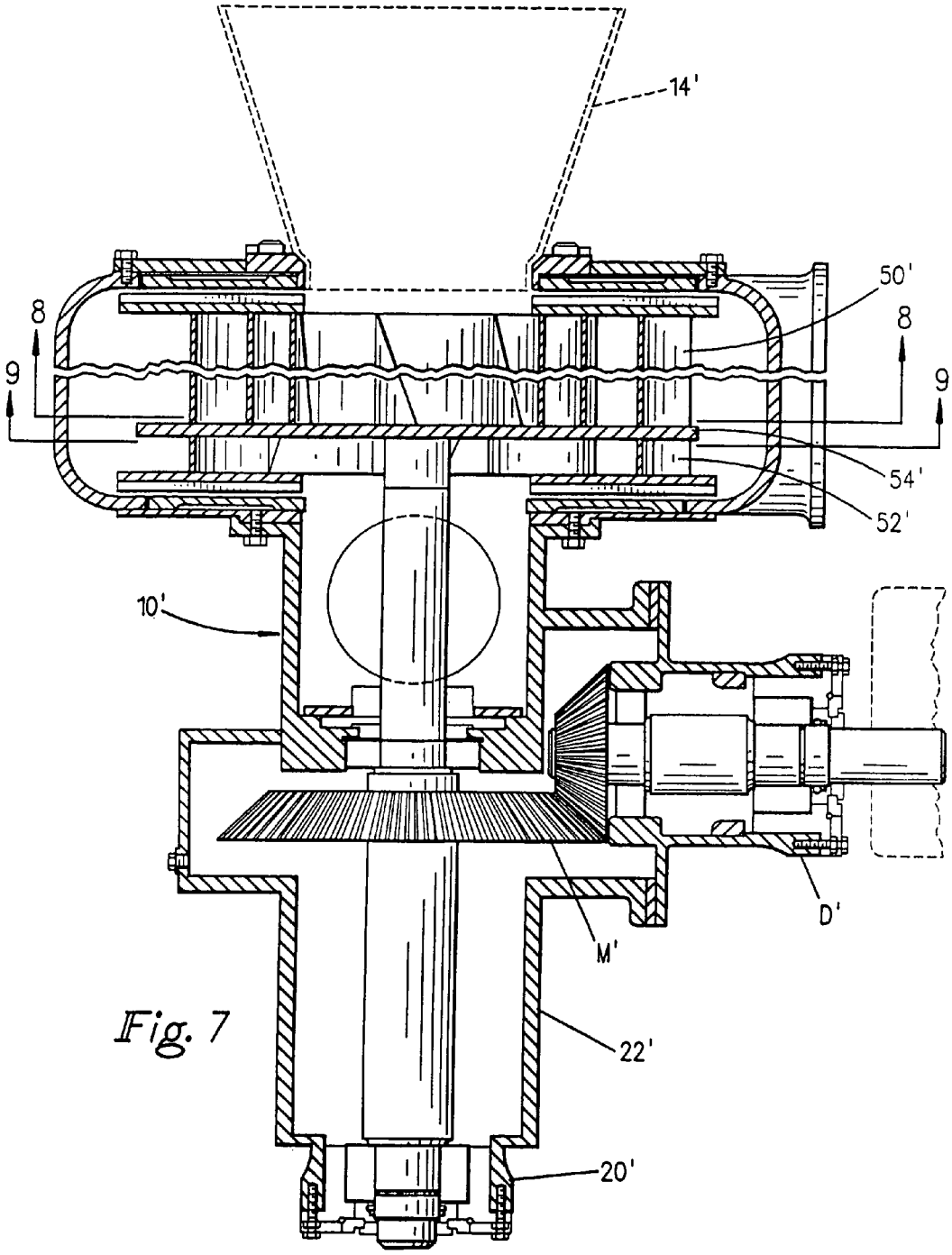
FIG. 7 is a longitudinal section view of a modified form of invention.
Figure 8:
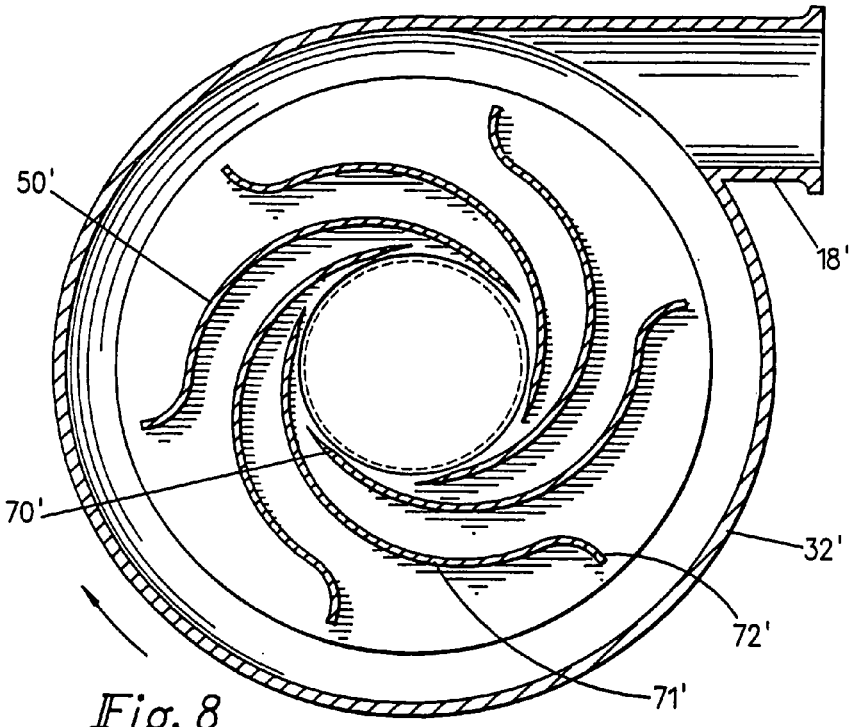
FIG. 8 is a cross-sectional view taken about lines 8-8 of FIG. 7.
Figure 9:
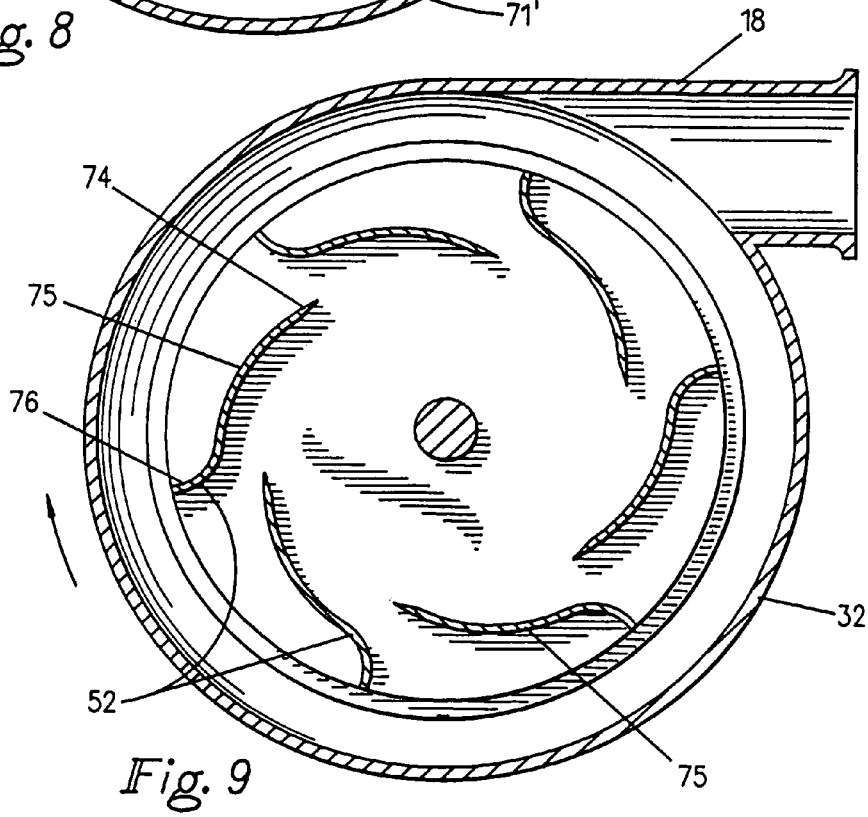
FIG. 9 is a sectional view taken about lines 9-9 of FIG. 7.

Referring in more detail to the drawings, a preferred form of blender apparatus is illustrated in FIGS. 1 to 5, and FIG. 6 illustrates a typical mounting of a blender apparatus on a truck T whether the apparatus be of the preferred form of blender apparatus 10 illustrated in FIGS. 1 to 5 or the modified form of apparatus 10' illustrated in FIGS. 7 to 9. In oil and gas operations, such as, fracturing or cementing wells, the apparatus 10 or 10' is mounted on a truck bed B including an engine E with a drive mechanism D to impart rotation via speed reducer mechanism M to a central drive shaft 12. The solid particulate matter, such as, sand is delivered from a storage area S by means of an auger system represented at A to the upper end of a hopper 14. There, the sand is permitted to advance by gravity into the apparatus 10 or 10'. The sand is thoroughly mixed with a liquid which is introduced through an inlet line $L_2$ into the inlet port 16; and the resultant slurry is discharged via outlet port 18 through a delivery line $L_1$ with sufficient pressure to be delivered to other trucks for delivery to a well head. The speed reducer M is a right angle drive as shown to enable the blender apparatus 10 to be oriented vertically in order to receive the sand and other dry chemicals under gravity flow through the hopper 14. The sand screw assembly or auger A has the capability of introducing sand from the storage area S to a point at least 10" above the inlet of the hopper 14 so that the mass flow rate of sand downwardly through the hopper is sufficient to produce the desired flow rate of sand through the discharge port. While the apparatus is described and shown as being truck-mounted, it will be appreciated that it can be as readily mounted on a fixed support and be oriented vertically or canted at an angle, such as, in the manner disclosed in hereinbefore referred to U.S. Pat. No. 5,904,419.

The apparatus 10 of the preferred form of invention is illustrated in more detail in FIGS. 1 to 5 and will be seen to be broadly comprised of a base mount 20 including a bearing to support the lower end of the drive shaft in journaled relation to the mount, a cylindrical wall or casing 22 extending upwardly from the base mount 20 into an enlarged housing area 24 for the speed reducer mechanism M, and an intermediate casing 26 includes a bearing 27 to which an intermediate portion of the drive shaft 12 is journaled. The upper end of the casing 26 terminates in a flange 28 which is attached by suitable fasteners 29 to a substantially flat underside 30 of an upper impeller housing 32 for an impeller assembly generally designated at 34 within the housing 32. The underside 30 is of annular configuration and disposed in outer spaced concentric relation to the drive shaft 12, the impeller assembly 34 being mounted for rotation on the drive shaft in a manner to be described.

The impeller housing 32 has a substantially flat top side 36 of annular configuration parallel to the underside 30 and joined to the underside 30 by an outer continuous wall 38 of generally convex or toroidal cross-sectional configuration. The hopper 14 converges downwardly through a central opening in the top side 36 and is centered with respect to the drive shaft 12. An upper flat, annular connecting plate 40 is attached by suitable fasteners to the top side 36 and has an inner thickened ring-like portion 42 attached by suitable fasteners to the top side 36 and wedged against a necked down portion 44 of the hopper 14. A butterfly valve 48 with suitable hand control arm 49 is mounted in the hopper to seal off the mixer when desired and can assist in regulating the flow rate of sand into the impeller housing 32. The discharge port 18 extends tangentially away from the outer wall 38 of the housing 32, and the inlet port 16 extends radially into the housing 26 immediately below the expeller housing 32.

An important feature of the present invention resides in the impeller assembly 34 which is comprised of upper impeller vanes 50 and lower impeller vanes 52 interconnected by a common plate 54 which is centered for rotation on the upper end of the drive shaft 12 by means of a cup-shaped retainer 56. The upper impeller vanes 50 are bounded by a cover plate 58 having radially extending, circumferentially spaced expeller vanes 60. The plate 58 is of annular configuration and mounted in surrounding relation to the lower edge 44 of the hopper 14. The top side 36 of the housing 32 has a downwardly projecting, circular rib 62 extending into a circular slot 64 in the cover plate 58 as well as the vanes 60, as best seen from FIGS. 1 and 2. The rib or baffle plate or deflector 62 cooperates with the expeller vanes 60 in minimizing any return flow of slurry or liquids toward the center region of the impeller.

The lower vanes 52 are similarly bounded by a bottom cover plate 66 having spaced expeller vanes 68 to discourage return flow of slurry or liquids around the underside of the housing. A rib 30' projects upwardly from the underside 30 of the housing 32 radially inwardly of the inner terminal edges of the plate 66 and vane 68 to cooperate in discouraging the return flow of slurry or liquids.

Figure 4:
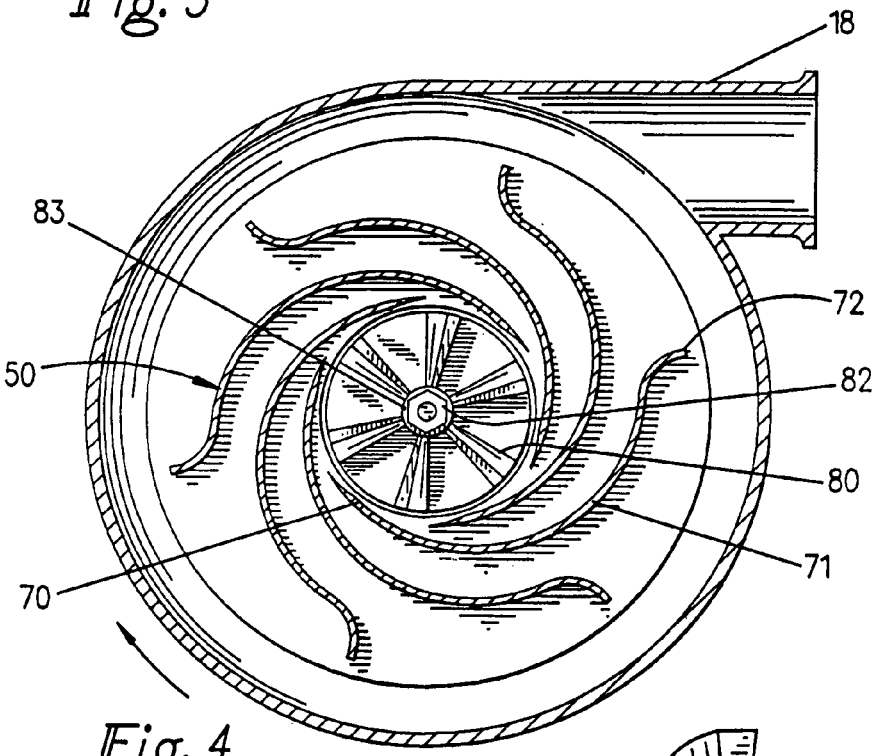
FIG. 4 is a cross-sectional view taken about lines 4-4 of FIG. 1.

The upper vanes 50 are shown in detail in FIG. 4, each having an inner edge or tip 70 substantially tangent to the inner radial edge of the cover plate 58 and curving radially and outwardly in a trailing direction to define a generally arcuate or concavo convex curvature at 71, then turning in a radial direction to terminate in outer tips 72 which are perpendicular to the direction of flow. The direction of curvature of the upper vanes 50 presupposes that the vanes are rotating in a clockwise direction when viewed upwardly. The vanes diverge gradually outwardly from one another and terminate in the tips 72 at the edge of the common plate 54 but inwardly of the outer edge of the cover plate 58.

Figure 1:
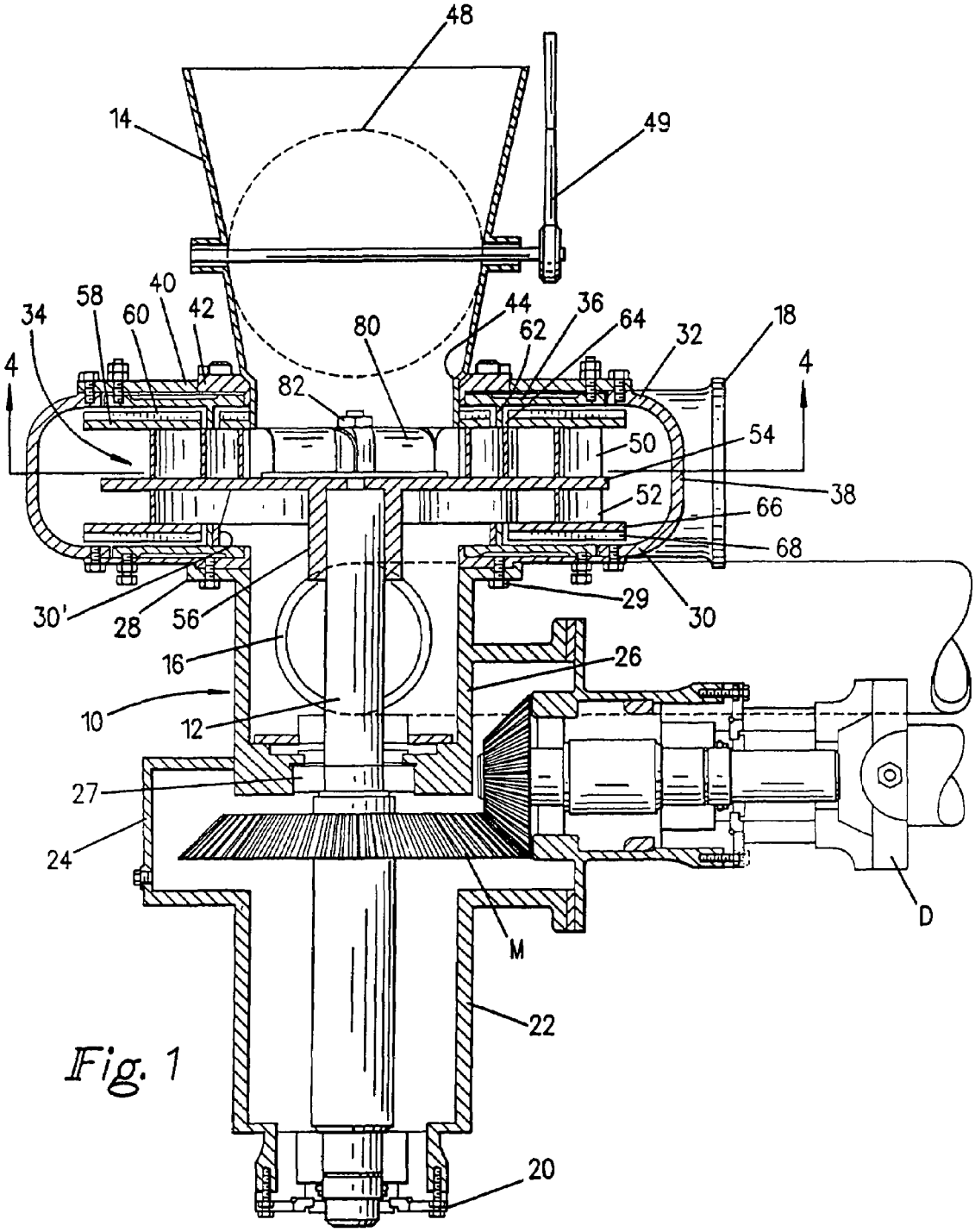
FIG. 1 is a longitudinal section view of a preferred form of invention taken vertically through the apparatus.
Figure 2:
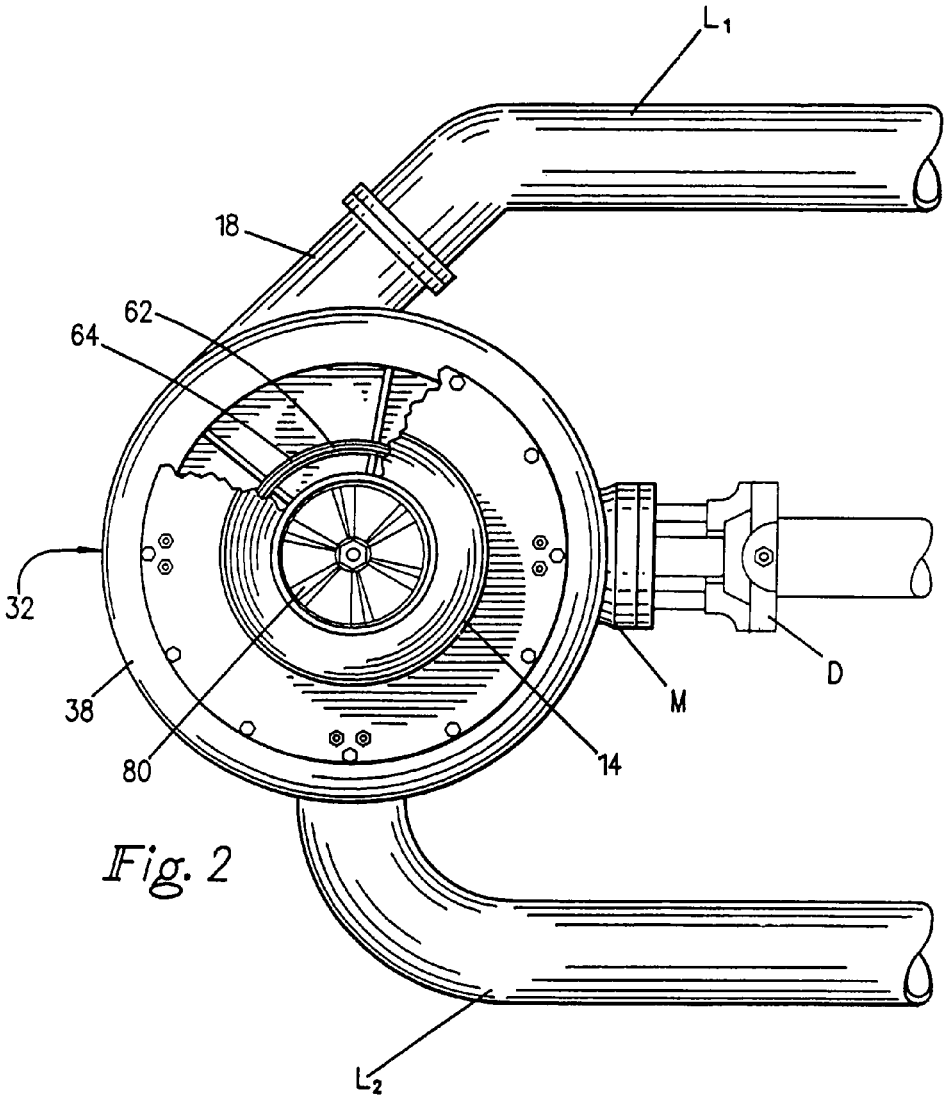
FIG. 2 is a top plan view partially in section of the preferred form of invention shown in FIG. 1.
Figure 3:
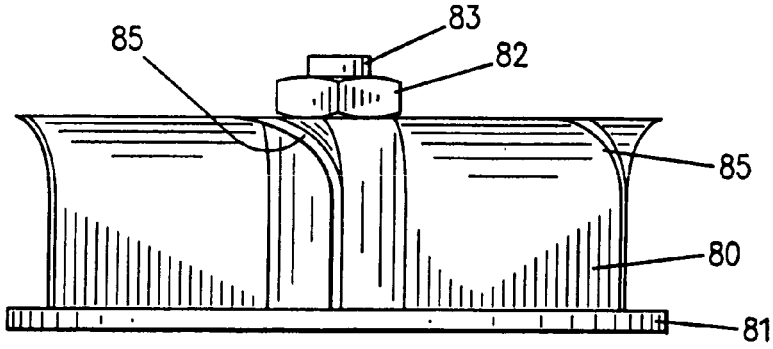
FIG. 3 is a view in detail of inner concentric impeller vanes employed on the upper impeller of the invention.
Figure 5:
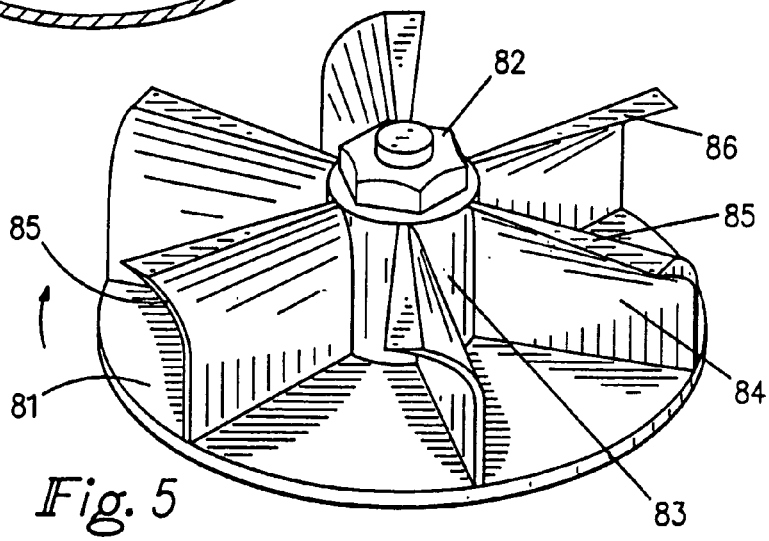
FIG. 5 is a somewhat perspective view of the impeller vanes illustrated in FIG. 3.
Figure 6:
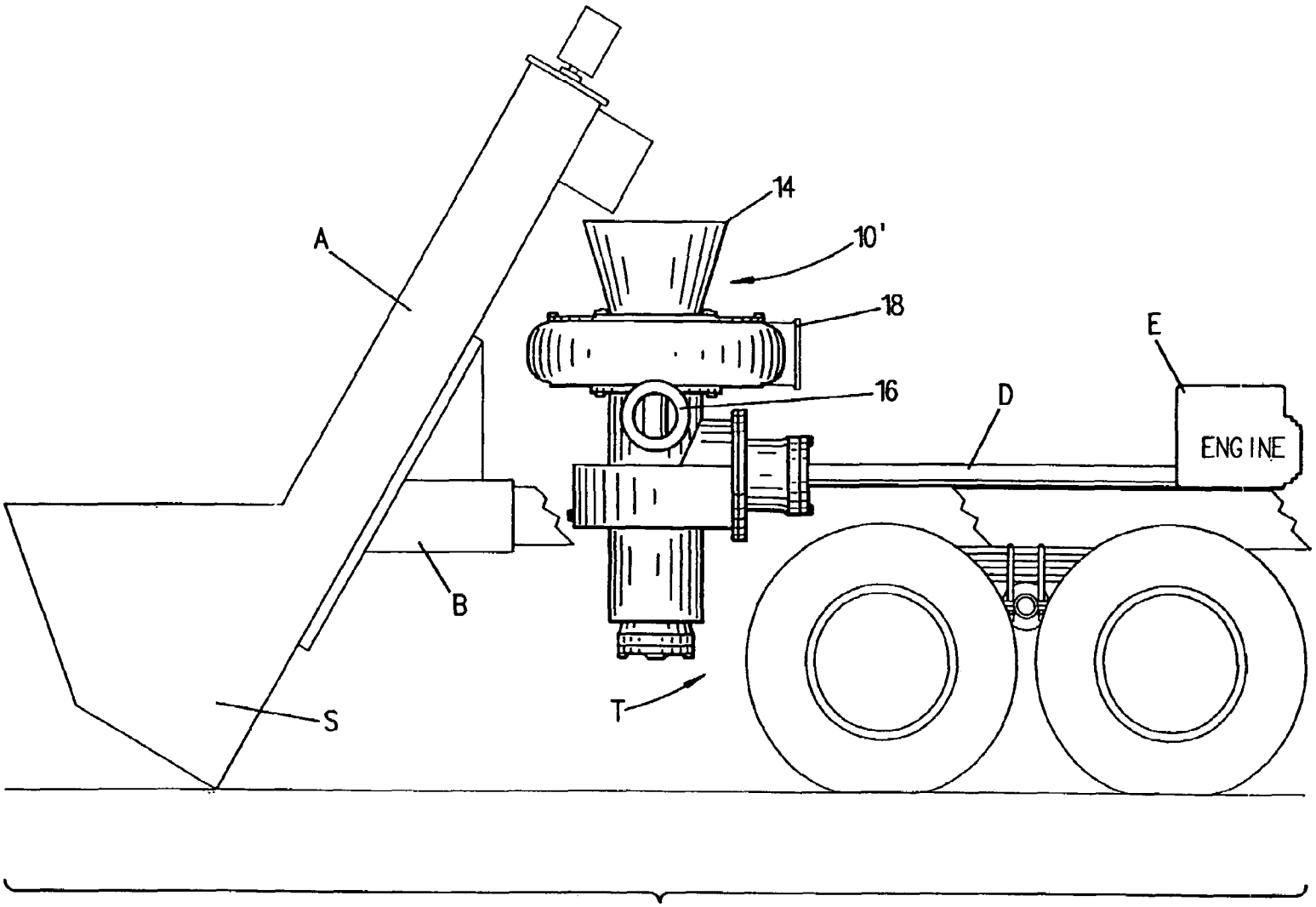
FIG. 6 is a fragmentary side elevational view of the preferred form of invention mounted on a truck.

As further illustrated in FIGS. 3 to 5, a plurality of expeller blades 80 are mounted on a base plate 81 which is affixed to the plate 54 at the eye of the impeller. The blades are keyed to the drive shaft 12 by a central fastener 82 threaded onto upper end portion of the shaft 12. Each of the blades 80 includes a flat radial portion 84 extending vertically and upwardly from the plate 81 and terminates in an upper curved or rounded portion 85 having a top machined or flattened surface 86. Preferably, the blades 80 correspond in number and spacing to the vanes 50 and are oriented or aligned with the entrances between the tips 70 of adjacent vanes 50 so as to redirect the incoming sand from the hopper 14 in a radial direction into the upper passages between the impeller vanes 50. The upper curved ends 85 are curved in the direction of rotation of the shaft 12 so as to confine the flow of the sand in an outward radial direction.

The lower vanes 52, as shown in FIG. 9, are of the same configuration as the upper vanes 50 including inner somewhat tangential tips 74, arcuate portions 75 and outer radial tips 76 which also terminate at the outer edge of the common plate 54 and are rotating at the same rpm but will oppose the entrance of liquid into the upper impeller region. Nevertheless, the liquid is under sufficient pressure to undergo counterflow into the upper impeller region until it reaches a balanced pressure condition with the sand being driven outwardly between the upper impeller vanes 50. As the upper vanes 50 approach the discharge port 18 the sand/water slurry will be driven outwardly under sufficient force by the vanes 50 as to overcome the counterflowing liquid and be discharged to the well head. The balance point or condition established between the sand and slurry is regulated to some extent by the relative length of the vanes 50 and 52. For example, as illustrated in FIGS. 4 and 9, the upper vanes 50 are substantially longer than the lower vanes 52 and in cooperation with the expeller blades 80 of sufficient velocity while maintaining the necessary high pressure condition to overcome the water pressure and be discharged through the port 18. Further, the combined use of the expeller blades 80 with the longer impeller vanes 50 will create greater pressure to push the water back at a balance point beyond the midpoint of the upper impeller vanes 50; and at the same time the height of the upper vanes 50 may be reduced to obtain the same capacity or mass rate of flow as substantially higher vanes, for example, as shown and described in the modified form of FIGS. 7 to 9. Maintaining the balance point at least beyond the midpoint of the upper vanes will help also to discourage leakage of water past the sand into the central inlet or eye of the impeller 34.

The following working example is given for the purpose of illustration in the utilization of the blender method and apparatus of the preferred form of invention in mixing sand and water and delivering continuously to a well head: The inlet end of the impeller at the lower reduced end 44 of the hopper 14 is 12" less the diameter of the center fastener 82 for the expeller blades 80, and the sand is delivered at a constant rate through the auger A to a point no less than 10" above the inlet in order to reach the design criteria of 30,000 lbs. of sand per minute through the opening. Again, in order to reach the design criteria of 30,000 lbs. of sand per minute through the outlet 18, the expeller blades 80 and impeller vanes 50 and 52 are greater than 0.62" in depth and are rotated at 1050 rpm. The water will enter the blender apparatus 10 through a 10" to 12" diameter inlet 16 and will not be accelerated until it reaches the vanes 52 whose inner tips are at a radius of 9". The water is accelerated by the vanes 52 until it reaches the outer tips of the vanes at a radius of 14" whereupon the liquid is driven into the annulus and energized to a pressure of approximately 100 psi. The liquid will then occupy the entire annulus and begin to invade the upper set of impeller vanes 50 which are rotating at the same rpm as the lower vanes and therefore opposing the entrance of the liquid into the upper section of the impeller. Once the liquid has reached a point 9" from the center of the upper vanes 50 it will have dissipated its energy somewhat, and any tendency of the liquid to reach the eye of the impeller will be overcome by the length of the upper vanes 50 which will be on the order of 8" compared to the lower vanes which are on the order of 5". Accordingly, the eye of the upper impeller will be free of liquid so as not to interfere with the introduction of the sand from the auger A.

The expeller blades 80 will impart a velocity on the order of 660" per second as a result of which it is not necessary to have a higher depth of sand expeller vane 50 than the depth of the lower water vanes 52. Thus, the depth of the upper vanes 50 may be more on the order of 0.6" to 1.0" and therefore considerably more compact for the mass rate of flow of sand being handled. In addition, the expeller blades 80 reduce the area of the vanes which must be exposed to the pressurized liquid and therefore reduces the torque required to maintain the requisite rpm and correspondingly reduces the horsepower required on the engine. It will be evident that the size of the inlet may be reduced depending upon the amount or capacity of sand and water being discharged and therefore minimize the net positive suction head required.

Figure 10:
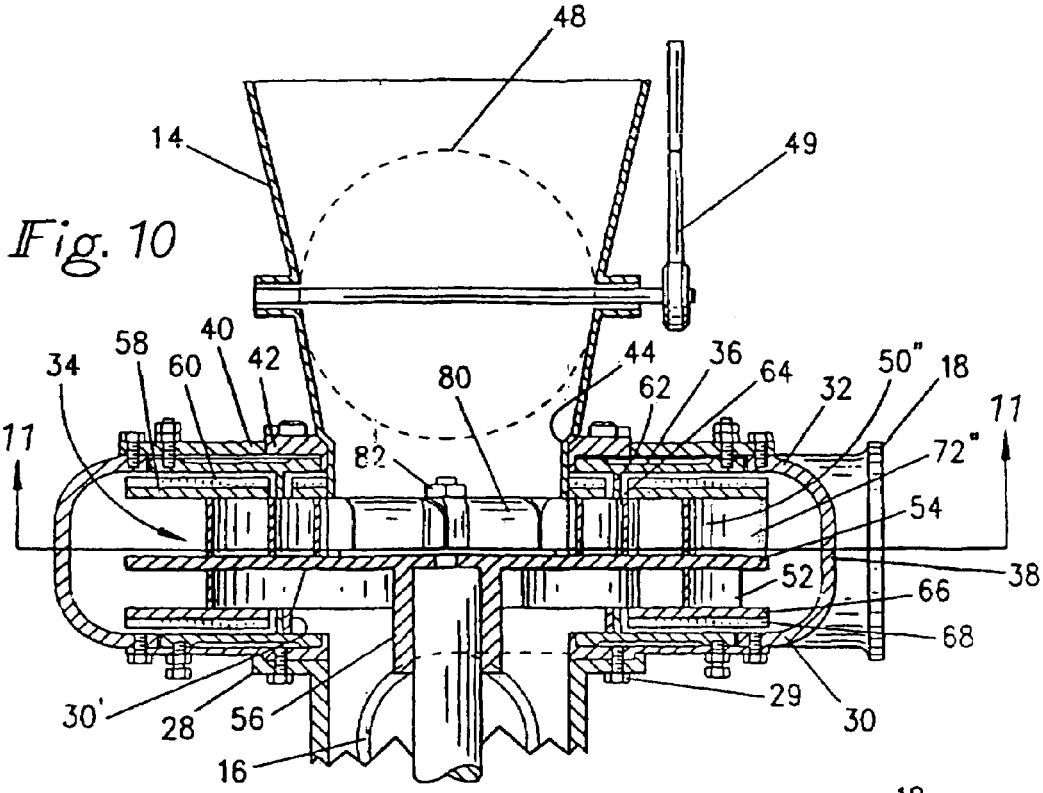
FIG. 10 is a fragmentary view of another preferred form of invention illustrating modifications to the vanes of the impeller assembly.
Figure 11:
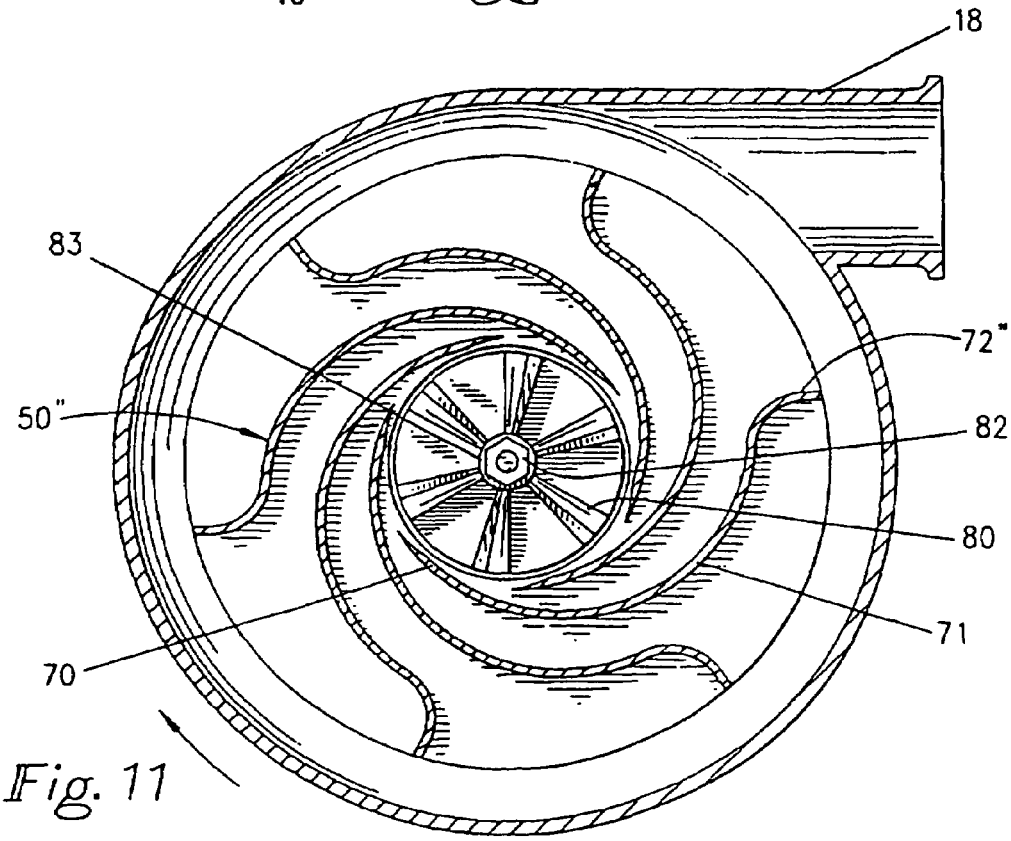
FIG. 11 is a cross-sectional view taken about lines 11-11 of FIG. 10.

Another preferred form of invention is illustrated in FIGS. 10 and 11 in which like parts are correspondingly enumerated to those of FIGS. 1 to 7, 8 and 9. Specifically, the upper vanes 50" have the same configuration as the vanes 50 and 50' of the preferred and modified forms hereinbefore described, but outer radial tips 72" are lengthened to extend to the outer peripheral edge of the common plate 54 in order to most effectively discourage the return flow of slurry or liquids toward the expeller blades 80.

Detailed Description of Modified Form of Invention

FIGS. 7 to 9 illustrate a modified form of blender apparatus 10' in which like parts are correspondingly enumerated with prime numerals. As shown in FIGS. 8 and 9, the vanes 50' and 52' are separated by a common plate 54' and are of corresponding configuration to the vanes 50 and 52 of the preferred form of invention. However, the upper vanes 50' are substantially increased in depth to compensate for the absence of the expeller blades 80 rapidly discharging the sand from the eye into the impeller vanes 50'. Thus, as represented, the increased depth of the inlet area beneath the hopper 14' as well as the increased depth and size of the upper impeller occupied by the vanes 50' may be varied and will enable greater amounts of sand to be introduced but at a much lower rate of flow. Furthermore, referring to the working example given with respect to FIGS. 1 to 5, in order to move a corresponding amount of sand would require an impeller vane 50' of a depth six to eight times greater than that of the preferred form. Nevertheless, the modified form of invention is similarly capable of delivering the mixture or slurry under the same pressure over a wide range of mass flow rates.

The vane configuration devised for the preferred and modified forms of invention enable close control over the pressure of the solid and liquid materials in order to achieve optimum performance. For example, when the vanes are curved in the same direction as the direction of rotation, the pressure increases as the rate of flow of the materials increases and, in curving away from the direction of rotation, the pressure will decrease. However, any tendency to decrease can be overcome by adding the straight radial portions 72 or 76 to the radially outer ends of the vanes. FIGS. 10 and 11 illustrate the lengthening of the blade tips 72" to be flush with the outer edges of the plate 54. As seen from FIGS. 4 and 9, the degree of curvature of the portions 71 and 75 as well as the relative length of the tips 72 and 76 can be varied to achieve different flow and pressure characteristics for a given rpm or speed of rotation of the vanes. It is therefore to be appreciated that the preferred and modified forms of invention are readily conformable for use in mixing various solids and liquids. It will be further evident that the vane configuration of the impeller vanes 50 and 52 is conformable for use in numerous applications other than blender apparatus and for example are adaptable for use in centrifugal pumps or in virtually any application where it is desirable to control the pressure of liquid or solid particles by regulating the curvature of the impeller vanes.

It is therefore to be understood that while preferred and modified forms of invention have been herein set forth and described, various modifications and changes may be made therein without departing from the spirit and scope of the present invention as defined by the appended claims.

We claim:

1. In apparatus for blending a liquid with solid particles wherein a housing has an upper solid particle inlet and a lower liquid inlet, a center drive shaft extending vertically through said housing, and an outlet in communication with an annular space in outer spaced surrounding relation to said drive shaft, the improvement comprising:

upper impeller means including a first series of circumferentially spaced vanes mounted for rotation on said shaft whereby to direct said solid particles from said particle inlet in a radial outward direction toward said annular space;

lower impeller means including a second series of circumferentially spaced vanes mounted for rotation on said shaft whereby to direct liquid from said liquid inlet through said annular space to intermix by counterflow of said liquid with respect to said solid particles prior to discharge of said solid particles into said annular space; and a common flat divider plate extending continuously between said upper and lower impeller means whereby to constrain the flow of liquid upwardly from said lower impeller means around the outside of said divider plate into said annular space and wherein said upper solid particle inlet includes a plurality of radially extending expeller blades on said divider plate in inner concentric relation to said upper impeller means.

2. In blender apparatus according to claim 1 wherein said upper impeller means include arcuate vanes extending radially and outwardly at circumferentially spaced intervals.

3. In blender apparatus according to claim 1 wherein said upper and lower impeller means include arcuate vanes, a cover plate mounted on said upper vanes, and a bottom plate attached to said lower vanes.

4. In blender apparatus according to claim 3 wherein said bottom plate and cover plate substantially correspond in outer diameter and said bottom plate has a larger inner diameter than said cover plate.

5. In blender apparatus according to claim 1 wherein each of said upper and lower impeller means is defined by arcuate vanes extending radially and outwardly into said annular space.

6. In blender apparatus according to claim 5 wherein said lower vanes are shorter than said upper vanes and terminate at the same outer diameter.

7. In blender apparatus according to claim 5 wherein said upper vanes have radially extending outer tips which terminate flush with said outer peripheral edge of said divider plate.

8. In blender apparatus according to claim 1 wherein said upper impeller means are defined by arcuate vanes terminating at their inner radial ends in circumferentially extending tip portions and terminating at their outer ends in radially extending tip portions.

9. In blender apparatus according to claim 8 wherein said lower impeller means are defined by arcuate vanes terminating at their inner ends in circumferentially extending tips and at their outer ends in radially extending tips.

10. In apparatus for blending a liquid with solid particles wherein an impeller housing has an upper solid particle inlet and a lower liquid inlet, a center drive shaft extending vertically through said housing, and an outlet in communication with an annular space in outer spaced surrounding relation to said drive shaft, the improvement comprising:

upper impeller means including a plurality of arcuate upper vanes mounted for rotation on said drive shaft for directing solid particles from said particle inlet in a radial outward direction toward said annular space;

lower impeller means including a plurality of arcuate lower vanes for directing liquid from said liquid inlet through said annular space to intermix with solid particles from said upper impeller means;

a common divider plate interposed between said upper and lower impeller means wherein said upper vanes terminate flush with an outer peripheral edge of said divider plate;

a plurality of circumferentially spaced, radially extending expeller blades in said particle inlet, said expeller blades being mounted for rotation on said common divider plate for directing particles radially from said inlet into said upper impeller means; and wherein said upper impeller means includes a cover plate surmounted on said upper vanes, and said lower impeller means includes a bottom plate mounted beneath said lower vanes.

11. In blender apparatus according to claim 10 wherein said cover plate includes expeller vanes on a surface opposite to said upper impeller vanes.

12. In blender apparatus according to claim 11 wherein said impeller housing encases said upper and lower impeller means and includes a first deflector member extending downwardly from a top side of said impeller housing into a circumferential slot in said cover plate.

13. In blender apparatus according to claim 12 wherein a second deflector member extends upwardly from an underside of said impeller housing into a circumferential slot in said bottom plate.

14. In blender apparatus according to claim 13 wherein said upper and lower vanes are curved in the direction of rotation of said upper and lower impeller means.

15. In blender apparatus according to claim 14 wherein said upper and lower vanes include radially outwardly extending straight tips terminating flush with said outer peripheral edge of said divider plate.

* * * * *